United States Patent [19]

Erickson

[11] 3,994,618

[45] Nov. 30, 1976

[54] MULTIPLE OUTLET PITOT PUMP WITH DIFFERENT OUTPUT FLOWS AND/OR PRESSURES

[75] Inventor: John W. Erickson, Huntington Beach, Calif.

[73] Assignee: Kobe, Inc., Huntington Park, Calif.

[22] Filed: Jan. 13, 1975

[21] Appl. No.: 540,605

[52] U.S. Cl. ..... 415/89; 233/27

[51] Int. Cl.[2] ..... F04D 1/14

[58] Field of Search ..... 415/88, 89; 233/21, 233/27

[56] References Cited

UNITED STATES PATENTS

| | | | |
|---|---|---|---|
| 528,690 | 11/1894 | Ponten et al. | 233/19 R |
| 561,192 | 6/1896 | Bartel et al. | 415/88 |
| 1,350,009 | 8/1920 | Del Valle | 233/21 |
| 1,722,289 | 7/1929 | Gurley | 415/89 |
| 2,831,323 | 4/1958 | Linsenmeyer | 415/89 |
| 3,004,495 | 10/1961 | Macklis | 415/89 |
| 3,384,024 | 5/1968 | King | 415/89 |
| 3,671,136 | 6/1972 | O'Mara et al | 415/88 |
| 3,776,658 | 12/1973 | Erickson | 415/88 |
| 3,817,659 | 6/1974 | Erickson et al. | 415/89 |
| 3,822,102 | 7/1974 | Erickson | 415/89 |

FOREIGN PATENTS OR APPLICATIONS

| | | | |
|---|---|---|---|
| 128,170 | 5/1932 | Austria | 415/88 |
| 1,094,563 | 5/1955 | France | 415/89 |
| 924,143 | 7/1947 | France | 233/21 |

*Primary Examiner*—C. J. Husar
*Attorney, Agent, or Firm*—Christie, Parker & Hale

[57] ABSTRACT

A multiple outlet pitot pump with different output flows and/or pressures, comprising: a rotary casing; means for delivering a fluid to be pumped to the rotary casing; at least two discharge ducts generally coaxial with the rotary casing; at least two pitot tubes in and extending radially of the rotary casing, the pitot tubes respectively having adjacent their outer ends inlets facing in a direction opposite to the direction of rotation of the rotary casing, the pitot tubes respectively having radial passages and having adjacent their inner ends outlets respectively connecting the inner ends of the radial passages to the discharge ducts, and the pitot tubes further respectively having circumferentially rearwardly extending passages connecting the inlets to the outer ends of the radial passages; the inlets being different radial distances from the axis of the rotary casing to deliver fluid to the discharge ducts at different pressures; and the inlets being of different sizes to deliver fluid to the discharge ducts at different flow rates.

3 Claims, 4 Drawing Figures

MULTIPLE OUTLET PITOT PUMP WITH DIFFERENT OUTPUT FLOWS AND/OR PRESSURES

BACKGROUND OF INVENTION

The present invention relates in general to centrifugal pumps and, more particularly, to a centrifugal pump of the pitot type, such a pump comprising, as its general elements, a rotary casing, means for delivering a fluid to be pumped to the rotary casing, a discharge duct coaxial with the rotary casing, and a pitot tube in the rotary casing for picking up fluid adjacent the periphery of the casing with a ram effect and for delivering the fluid to the discharge duct. More particularly, the pitot tube extends radially of the rotary casing and is provided adjacent its outer end with an inlet adjacent the periphery of the rotary casing and facing in a direction opposite to the direction of rotation of the rotary casing. The pitot tube is provided with a circumferentially rearwardly extending passage connecting the inlet to the outer end of a radial passage within the pitot tube, such radial passage having adjacent its inner end an outlet communicating with the discharge duct.

CROSS REFERENCE TO RELATED APPLICATION

In the sense that the present application discloses a pitot pump having multiple pitot tubes respectively connected to corresponding outlets, the present application is related to copending application Ser. No. 508,427, now U.S. Pat. No. 3,977,810 filed Sept. 23, 1974 by Walter W. Crichlow and me, and assigned to the same assignee as the present application.

OBJECTS AND SUMMARY OF INVENTION

The primary object of the invention is to provide a multiple outlet pitot pump having different output flows and/or pressures.

More particularly, an important object of the invention is to provide at least two pitot tubes respectively connected to separate discharge ducts and having inlets of different sizes to deliver fluid to the discharge ducts at different flow rates.

Another important object is to provide at least two pitot tubes respectively connected to separate discharge ducts and having inlets different radial distances from the axis of the rotary casing to deliver fluid to the discharge ducts at different pressures.

Thus, the invention may be summarized as comprising, and another important object is to provide a pitot pump which comprises: a rotary casing; means for delivering a fluid to be pumped to the rotary casing; at least two discharge ducts generally coaxial with the rotary casing; at least two pitot tubes in and extending radially of the rotary casing, the pitot tubes respectively having adjacent their outer ends inlets facing in a direction opposite to the direction of rotation of the rotary casing, the pitot tubes respectively having radial passages and having adjacent their inner ends outlets respectively connecting the inner ends of the radial passages to the discharge ducts, and the pitot tubes further respectively having circumferentially rearwardly extending passages connecting said inlets to the outer ends of the radial passages; and the inlets being of different sizes and/or different radial differences from the axis of the rotary casing to deliver fluid to the discharge ducts at different flow rates and/or different pressures.

Thus, any desired flow rate and/or discharge pressure may be achieved with a single pitot pump, which is an important feature of the invention.

The foregoing objects, advantages, features and results of the present invention, together with various other objects, advantages, features and results thereof which will be evident to those skilled in the pitot pump art in the light of this disclosure, may be achieved with the exemplary embodiment of the invention illustrated in the accompanying drawings and described in detail hereinafter.

DESCRIPTION OF EXEMPLARY EMBODIMENTS OF INVENTION

Figure 1:
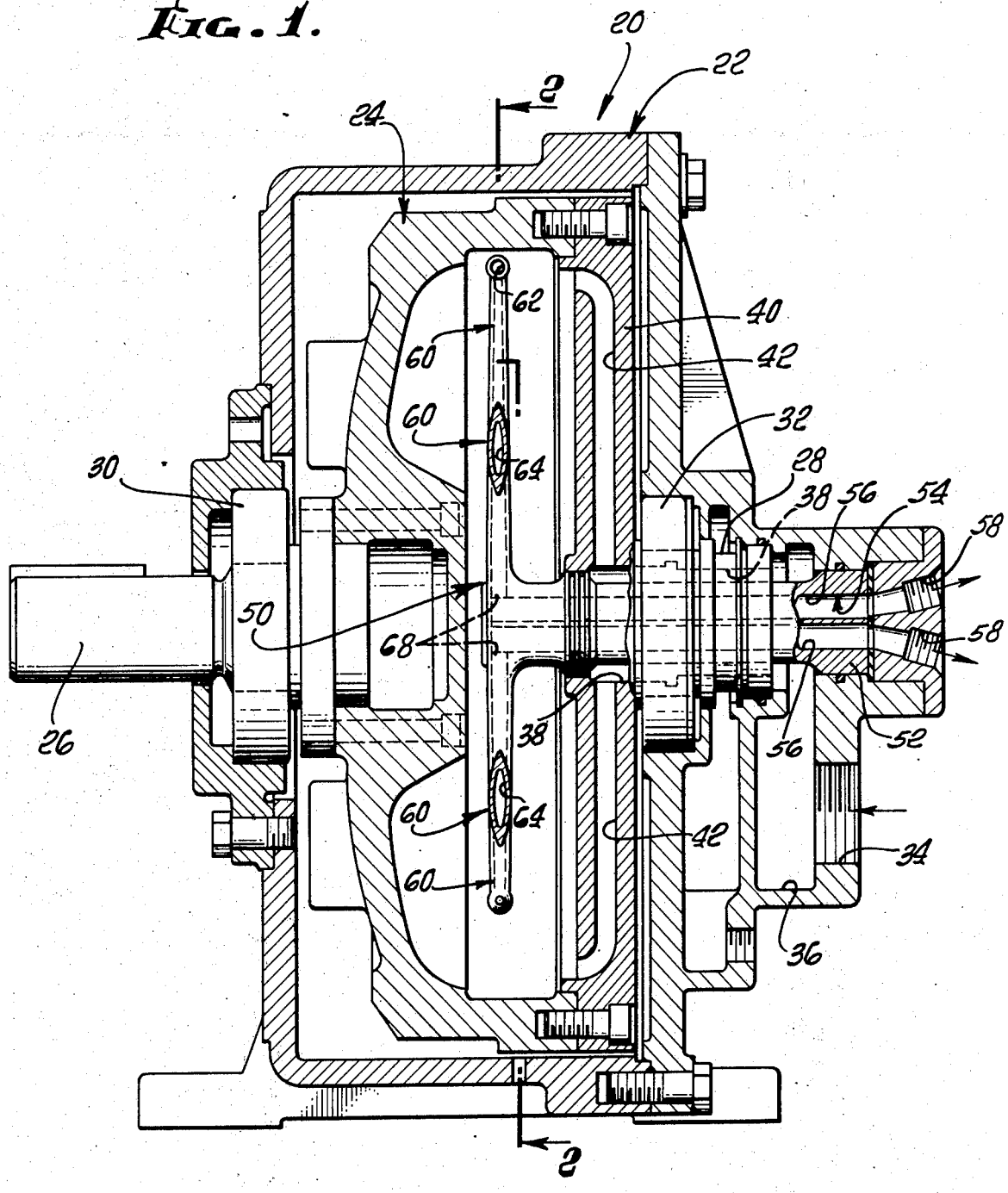
FIG. 1 is a longitudinal sectional view of a multiple outlet pitot pump with different output flows and/or pressures, which embodies the invention.
Figure 2:
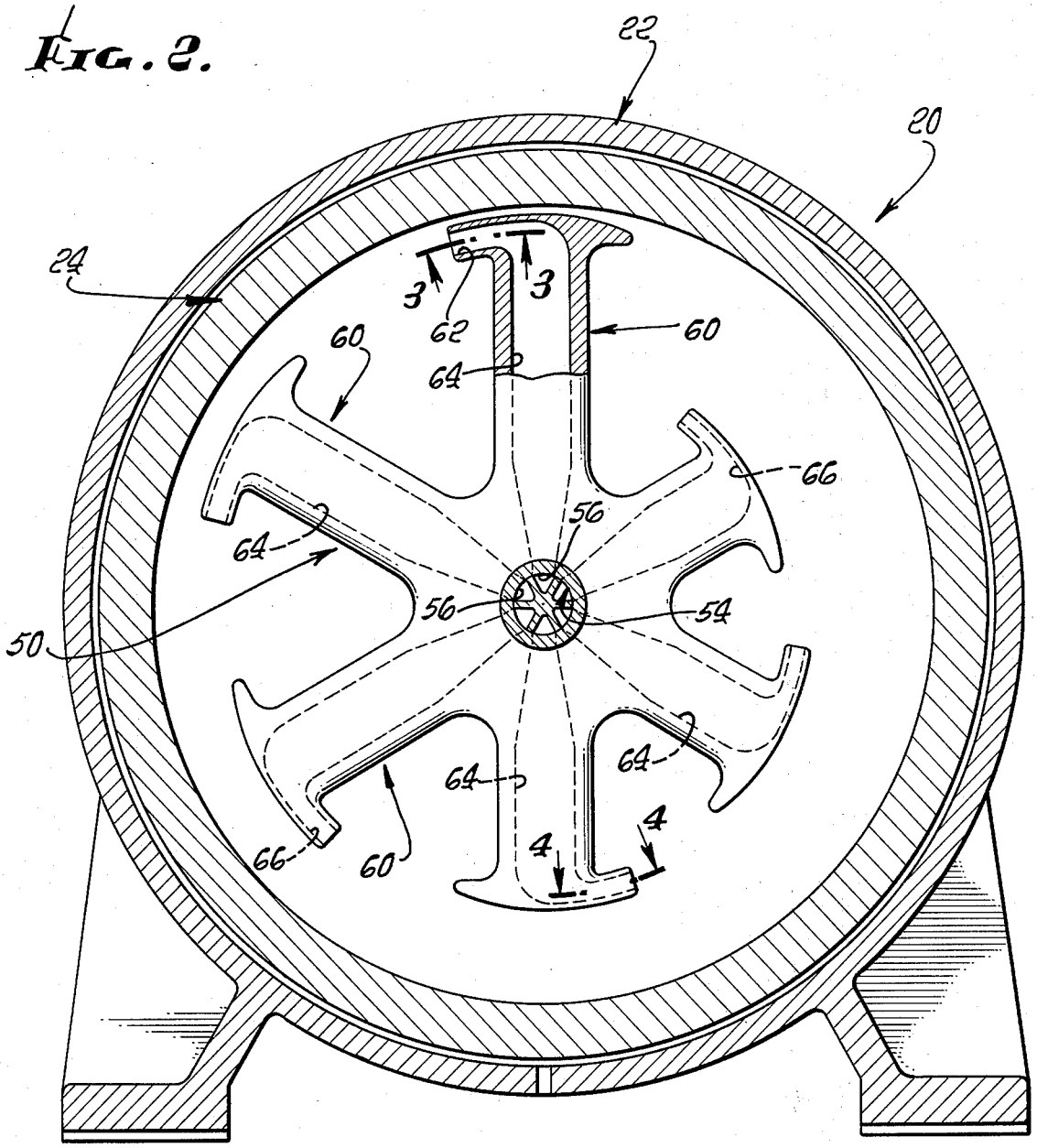
FIG. 2 is a transverse sectional view taken as indicated by the arrowed line 2—2 of FIG. 1.

Referring initially to FIGS. 1 and 2 of the drawings, illustrated therein is a pitot pump 20 comprising an outer housing 22 containing a rotary casing 24. In the particular construction illustrated, the rotary casing 24 is provided with coaxial shafts 26 and 28 carried by bearings 30 and 32 mounted in the housing 22. The shaft 28 is tubular. Also shown in FIG. 1 are suitable shaft seals which are unnecessary to describe. The rotary casing 24, in the particular construction illustrated, may be driven by any suitable means connected to the shaft 26.

The housing 22 is provided with an inlet 34, FIG. 1, for the liquid fuel, or other fluid, to be pumped, which inlet communicates with a chamber 36 leading to an annular passage 38 extending into one end wall 40 of the rotary casing 24. Within such end wall are circumferentially spaced, generally radial passages 42 which communicate at their inner ends with the annular passage 34 and which communicate at their outer ends with the interior of the rotary casing 24 adjacent the inner periphery thereof.

Within the rotary casing 24 is a pitot or pickup tube assembly 50 of the invention. This assembly, which is stationary, is carried by a tubular support 52 coaxial with the housing 22 and the rotary casing 24 and suitably secured to the housing. The tubular support 52 is provided with an axial outlet passage 54.

The axial outlet passage 54 is divided throughout its length into a plurality of discharge ducts 56 which terminate at their outer or downstream ends in discharge ports 58. These discharge ports are respectively connected to devices, not shown, to which it is desired to deliver a fluid at different flow rates and/or pressures, as will be described.

The pitot tube assembly 50 includes a plurality of circumferentially spaced pitot tubes 60 in and extending radially of the rotary casing, such pitot tubes respectively having adjacent their outer ends inlets or noses 62 facing in a direction opposite to the direction of rotation of the rotary casing. The pitot tubes 60 respectively have radial passages 64 connected at their outer ends to the noses 62 by circumferentially rearwardly extending passages 66. The pitot tubes 60 are respectively provided at their inner ends with outlets 68 respectively connecting the radial passages 64 thereof to the discharge ducts 56.

The general mode of operation of the pitot pump 20 is well known so that it does not need to be described in detail. Briefly, the centrifugal force produced by the rotation of the casing 24 generates a high fluid pressure adjacent the inner periphery of the casing. The fluid at this high pressure enters the noses or inlets 62 of the pitot tubes 60, the pressure being further increased by the ram effect resulting from so orienting the inlets 62 that they face in a direction opposite to the direction of rotation of the rotary casing 24. The fluid entering the pitot tubes 60 is delivered to the respective discharge ports 58 through the passages 66, the passages 64, the outlets 68, and the discharge ducts 56.

Figure 3:
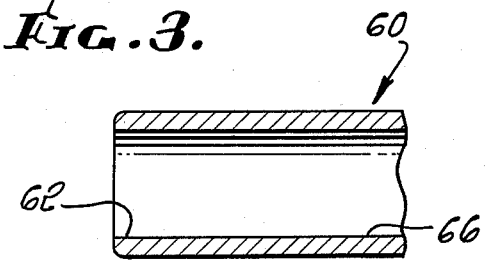
FIGS. 3 and 4 are enlarged, fragmentary sectional views respectively taken along the arrowed lines 3—3 and 4—4 of FIG. 2 and respectively showing pitot tubes having inlets of different sizes to produce different flow rates.
Figure 4:
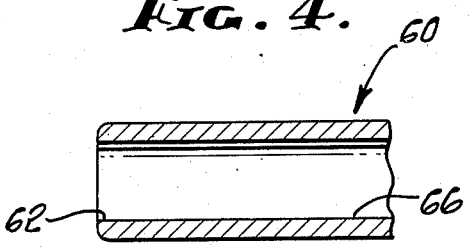

The important feature of the present invention is that the inlets 62 of the pitot tubes 60 are located different distances from the axis of rotation of the rotor 24 to produce different output pressures. Also, the inlets 62, as will be clear from a comparison of FIGS. 3 and 4, are of different sizes to produce different output flows to the ports 58.

While all of the inlets 62 are shown as being located at different distances from the axis, and are shown as being of different sizes, some of the inlets can be located the same distance from the axis and/or be of the same size, depending upon the requirements of the devices, not shown, connected to the outlet ports 58 and to which the fluid being pumped is delivered. Also, it will be understood that the number of pitot tubes 60 and corresponding discharge ports 58 may be varied, there being no intention of limiting the invention to the specific number, i.e., six, shown. Further, while the pitot tubes 60 are shown circumferentially spaced apart in the same transverse plane, it will be understood that they may be staggered axially of the pitot pump 20 so that no pitot tube operates directly in the slipstream or backwash of the pitot tube ahead of it. Alternatively the pitot tubes 60 shown may be divided into groups with each group in a different transverse plane. Also, if desired, the inlets 62 may be so configured as to produce constant flows at different pressures, in accordance with the aforementioned copending patent application.

Although an exemplary embodiment of the invention has been disclosed for illustrative purposes, it will be understood that various changes, modifications and substitutions may be incorporated in such embodiment without departing from the invention as hereinafter claimed.

I claim as my invention:

1. In a multiple outlet pitot pump, the combination of:

a. a rotary casing containing a pumping chamber;

b. means for delivering a fluid to be pumped to the pumping chamber in said rotary casing;

c. at least two discharge ducts generally coaxial with said rotary casing;

d. at least two pitot tubes in and extending radially of said rotary casing, said pitot tubes respectively having adjacent their outer ends inlets in the pumping chamber facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages; and e. said inlets being of different sizes to deliver fluid to said discharge ducts at different flow rates.

2. In a multiple outlet pitot pump, the combination of:

a. a rotary casing containing a pumping chamber;

b. means for delivering a fluid to be pumped to the pumping chamber in said rotary casing;

c. at least two discharge ducts generally coaxial with said rotary casing;

d. at least two pitot tubes in and extending radially of said rotary casing, said pitot tubes respectively having adjacent their outer ends inlets in the pumping chamber facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages; and e. said inlets being different radial distances from the axis of the rotary casing to deliver fluid to said discharge ducts at different pressures.

3. In a multiple outlet pitot pump, the combination of:

a. a rotary casing containing a pumping chamber;

b. means for delivering a fluid to be pumped to the pumping chamber in said rotary casing;

c. at least two discharge ducts generally coaxial with said rotary casing;

d. at least two pitot tubes in and extending radially of said rotary casing, said pitot tubes respectively having adjacent their outer ends inlets in the pumping chamber facing in a direction opposite to the direction of rotation of said rotary casing, said pitot tubes respectively having radial passages and having adjacent their inner ends outlets respectively connecting the inner ends of said radial passages to said discharge ducts, and said pitot tubes further respectively having circumferentially rearwardly extending passages connecting said inlets to the outer ends of said radial passages;

e. said inlets being different radial distances from the axis of the rotary casing to deliver fluid to said discharge ducts at different pressures; and f. said inlets being of different sizes to deliver fluid to said discharge ducts at different flow rates.

* * * * *